US010126097B2

(12) United States Patent
Schweitzer

(10) Patent No.: US 10,126,097 B2
(45) Date of Patent: Nov. 13, 2018

(54) PURSE MOUNT DEVICE

(71) Applicant: Couture Conceal, LLC, Cranberry, PA (US)

(72) Inventor: Caresse L. Schweitzer, Pittsburgh, PA (US)

( * ) Notice: Subject to any disclaimer, the term of this patent is extended or adjusted under 35 U.S.C. 154(b) by 174 days.

(21) Appl. No.: 15/043,815

(22) Filed: Feb. 15, 2016

(65) Prior Publication Data

US 2017/0234648 A1 Aug. 17, 2017

(51) Int. Cl.
*F41C 33/00* (2006.01)
*F41C 33/02* (2006.01)
*F41C 33/04* (2006.01)

(52) U.S. Cl.
CPC ..... *F41C 33/0218* (2013.01); *F41C 33/048* (2013.01)

(58) Field of Classification Search
CPC ..... F41C 33/0218; F41C 33/048
See application file for complete search history.

(56) References Cited

U.S. PATENT DOCUMENTS 5,251,798 A * 10/1993 Theodore ..... F41C 33/0227 224/192
5,833,095 A * 11/1998 Russell ..... A45F 5/02 206/373
7,845,501 B1 * 12/2010 Fosburg ..... B25H 3/04 211/103
D691,369 S 10/2013 Holschuh
8,936,150 B1 1/2015 Whaley
2006/0011686 A1 * 1/2006 Latham ..... B60R 7/04 224/579
2011/0297498 A1 * 12/2011 Yu ..... A45C 5/06 190/110
2012/0055822 A1 * 3/2012 Bullock ..... A45C 11/00 206/320
2013/0037185 A1 * 2/2013 Hubbell ..... A45C 3/08 150/106
2014/0021235 A1 1/2014 Hunter
2014/0158733 A1 * 6/2014 McDonnell ..... B60R 7/14 224/587
2015/0150359 A1 * 6/2015 Lowry ..... A45F 5/00 224/222
2015/0300777 A1 10/2015 Stalker

* cited by examiner

*Primary Examiner* — Tri Mai
(74) *Attorney, Agent, or Firm* — The Lynch Law Group, LLC; Kathleen Ruznicki

(57) ABSTRACT

Purse carry is an option for carrying a handgun and providing effective concealment. A caveat to purse carry is that placement of a bolstered handgun in a purse makes it less accessible and can cost precious seconds to draw in a self-defense situation. Disclosed is a purse mount device that addresses and minimizes this problem and is capable of being used in various purses and is capable of being used with various handgun/holster combinations.

17 Claims, 6 Drawing Sheets

PURSE MOUNT DEVICE

BACKGROUND

Persons routinely carry handguns in holsters designed to protect the handgun and hold it securely on their body in a concealed manner. Common body placement for concealing a holster is on a belt at the waist, on the thigh, under an arm, and/or around an ankle. Many people find it uncomfortable to carry a handgun in one of these positions, and women in particular, find it hard to conceal due to having a more curvy body shape and tighter fitting clothing styles as compared to men. As a result, many women are now interested in way to facilitate the conceal carrying of a handgun off their body and in their handbag or purse.

Unfortunately, holster designs configured to be worn on the body are generally not suitable for use within a purse as they provide no way of positioning the handgun for a quick and easy draw. In response, purses configured to act as a handgun bolster have been developed. However, these purses have several disadvantages. First, the selection of purses configured to act as a handgun holster is limited. Second, these designs do not allow a user to carry a handgun within a purse they currently own or one produced by a different designer. Third, many of these purse designs are unattractive and expensive. What is needed is a mount that fits comfortably in a purse that allows a bolstered handgun to be readily available for a quick and easy draw, with the mount capable of being used with common interior purse designs such that it could be used with numerous purses from various designers, including ones that are currently owned by users.

SUMMARY OF THE INVENTION

Disclosed is a purse mount device capable of being used in various purses and capable of being used with various handgun/holster combinations. Most preferred characteristics of the device is that it has a low profile, that it is easily securable within a purse, but also that it is easily releasable to switch purses, that it is easily adjustable for height for holding various bolstered handguns within different purses, and that it is durable to survive everyday conceal carrying.

DETAILED DESCRIPTION

Figure 1A:
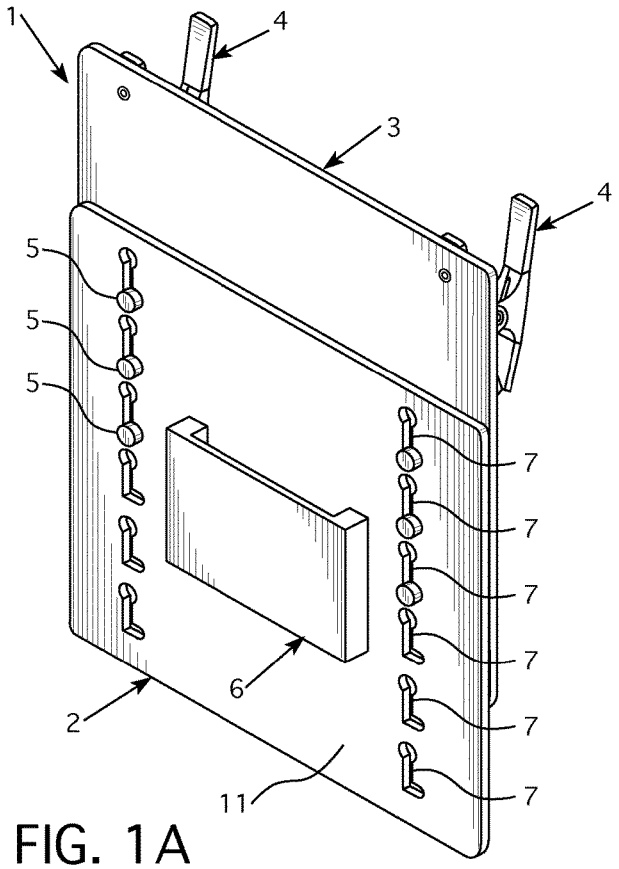
FIG. 1A: Assembled view of an embodiment of the device at a lower height position.

Everyday conceal carrying of a handguns on the body provides challenges. Selection of the best gun and holster combination is very important for every individual who chooses to conceal carry on their body. There must be balance between the comfort of carrying a bolstered handgun for everyday normal activities and the risk of "printing", i.e. revealing the presence of a handgun secured on the body. Handgun/holster combination choices can be very limiting for some people, especially women. Women have unique demands on their concealed carry choices that men do not have due to the shape and curves of the female figure as well as the impractical trends of ladies' fashions for conceal carry purposes. Many holsters are designed without female's curves in mind and feature a flat or otherwise uncompromising backing. If an inside- or outside-the-waistband holster doesn't somewhat fit the bends of a female hip and lower back, it often does not stay securely positioned and may "flop" to some degree during regular body motion. That "flop" makes a concealed carry handgun more noticeable (a moving handgun definitely prints more than one that is entirely stable). A non-secure handgun could also have an adverse effect to one's ability, to draw quickly and effectively in a self-defense situation. Some holsters are designed for certain size and/or caliber of handgun, while other holsters are customized for a specific handgun design. Most of these typical holsters are for carrying a handgun on the body are not functional or practical for concealed purse carry, an option many women, would like to have available, considering the above described problems.

Purse carry is an alternative option for carrying a handgun and providing effective concealment. Purse carry allows for a larger range of handgun/holster combinations and may allow for carry of a larger handgun size that cannot be easily concealed on the body. The option to purse carry is sometimes the only option available to women when their clothing choice prevents them from carrying any other way. A caveat to purse carry is that placement of a bolstered handgun in a purse makes it less accessible and can cost precious seconds to draw in a self-defense situation. The purse mount device addresses and minimizes this problem. The purse mount device makes concealed handgun bolster purse carry a more viable and practical option. The purse mount device comprises a holster support that is sized to accommodate a variety of handgun holster combinations. One advantage of the purse mount device is that it connects to side pocket(s) found within the interior of most purses. Many fashionable/functional purses have duel side pockets of varying sizes adjacent to one another on a single side of the purse and larger zippered pocket on the opposite side. It is most preferred to connect the device to both dual side pockets. Another advantage is that the design allows for height adjustment of the bolster support within the purse to accommodate various handgun holster combinations, and allowing for easier and quicker drawing of a handgun in a self-defense situation. Furthermore, the device gives a "soft" purse the ability and stability to carry the firearm safely.

Figure 1B:
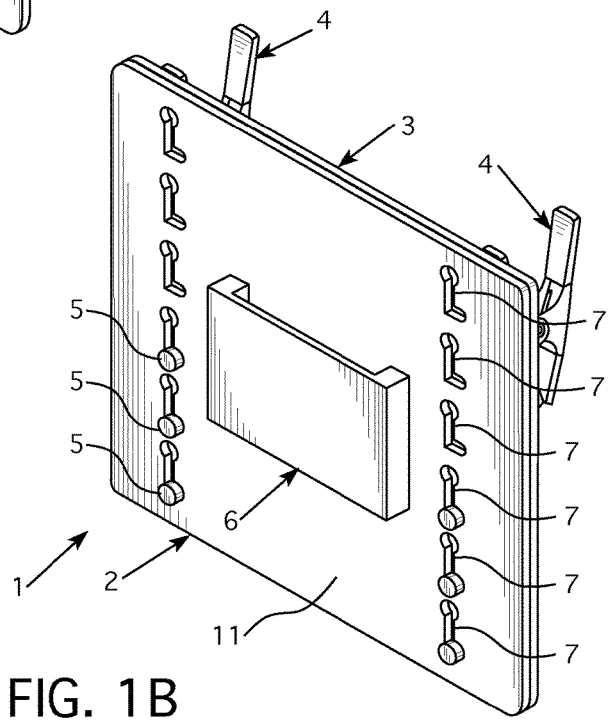
FIG. 1B: Assembled view of an embodiment of the device at a higher height position.
Figure 1C:
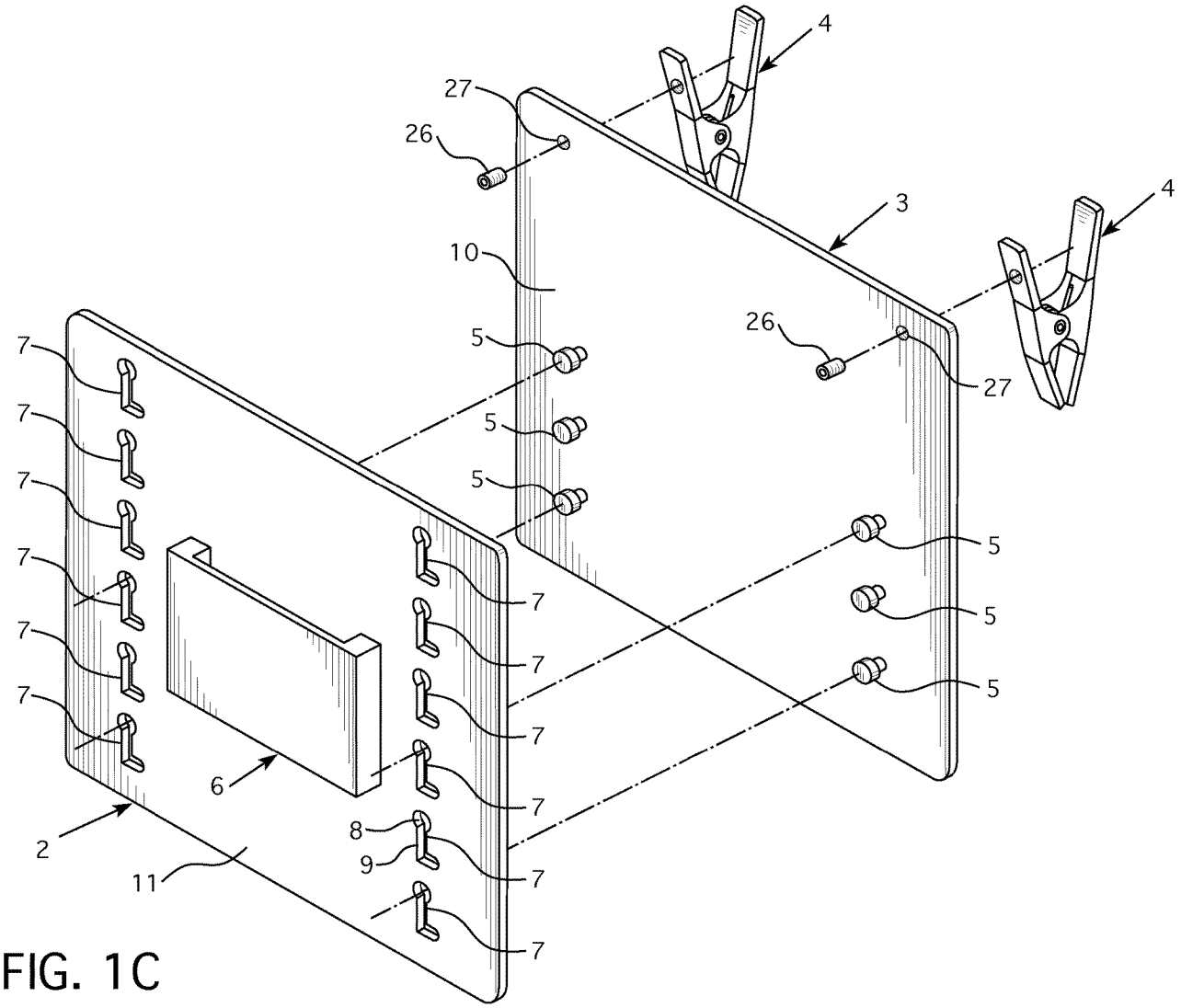
FIG. 1C: Disassembled view of an embodiment of the device.

FIG. 1 shows an embodiment of the purse mount device that allows a user to secure a holster in a variety of purse sizes with various heights as well as differing heights within a purse. FIG. 1*a* shows an assembled view the device 1 at a lower height position for this embodiment and FIG. 1*b* shows an assembled view of the device 1 at a higher height position for this embodiment. FIG. 1C shows a disassembled view of device 1. Device 1 is comprised of panel 2 and base plate 3. Base plate 3 is comprised of a plurality of pegs 5 on a front side 10 and attached clips 4. Panel 2 is comprised of a holster support 6 on a front side 11 and a plurality of panel holes 7 that extend from the front side 11 through the back. Preferably panel holes 7 have a rounded shape space 8 in an upper position and an L shape space 9 in a lower position. Panel 2 and base plate 3 interlock via pegs 5 and panel holes 7 to form assembled purse mount device 1. In this embodiment, holster support 6 is shown placed in approximately a central position, but it will be appreciated that any feasible position for the holster support can be used. Bolster support 6 is also sized to secure the various common sizes of holsters that hold various common conceal carry handguns. However, panel 2 can be manufactured with holster supports of alternative sizes to accommodate a further variety of handgun holster combinations. Preferably panel 2 and base plate 3 are manufactured using an injection molding technique, thus, having the holder support 6 and panel 2 as one solid manufactured piece and base plate 3 and pegs 5 as one solid manufactured piece. However, other embodiments in which the holster support is a separately attached piece from the panel and in which pegs are separately attached pieces from base plate are also contemplated by this disclosure and described in figures below. The preferred shape of both the panel 2 and the base plate 3 is shown here as a square with rounded corners. However, any feasible shape for the panel 2 and the base plate 3 are contemplated embodiments of the purse mount device. Attached clips 4 are contemplated to be any reasonable shape for connecting or grasping and can be attached to base plate 3 in any reasonable manner. As shown here in FIG. 1 it is preferred that the clips 4 be spring clamps; said spring clamps may or may not have coating material on either the tips end or the handles end and are connected to device via rivets 26 placed in baseplate holes 27.

Figure 2:
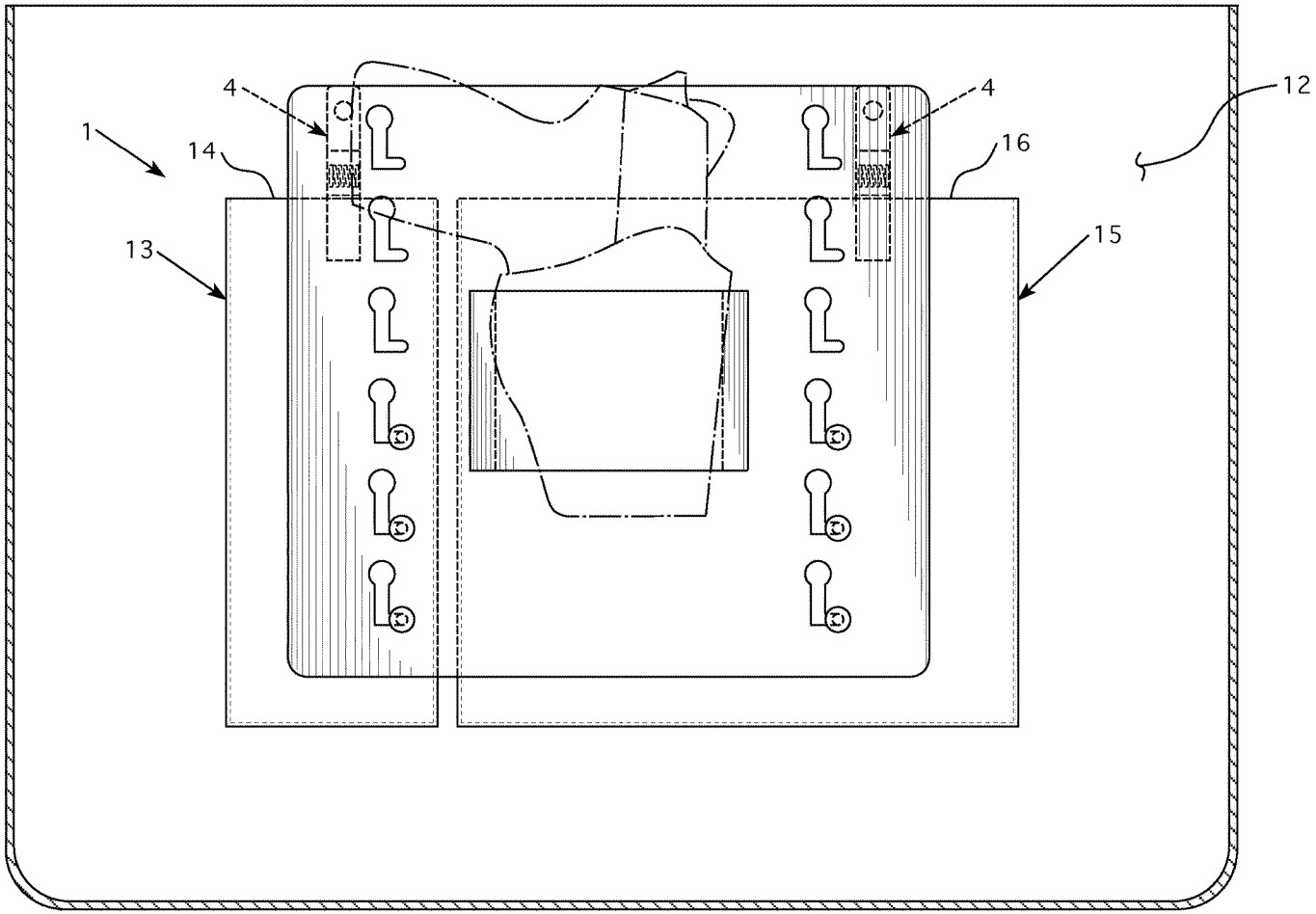
FIG. 2: Depiction of an embodiment of the device securing a bolstered handgun in a purse interior.

FIG. 2 shows how the purse mount device 1 connects to a purse interior to secure a bolstered handgun (outline shown in dashed lines). Standard purse interior 12 is comprised of small side pocket 13 with front side 14 and large side pocket 15 with front side 16. Clips 4 are inserted into or grasp the both front side 14 and front side 16 to secure the device 1 to both side pockets 13 and 15. The dual pocket design is common in many types of purses; however the purse mount device can be used m alternative purse designs using pockets in the interior.

Figure 3:
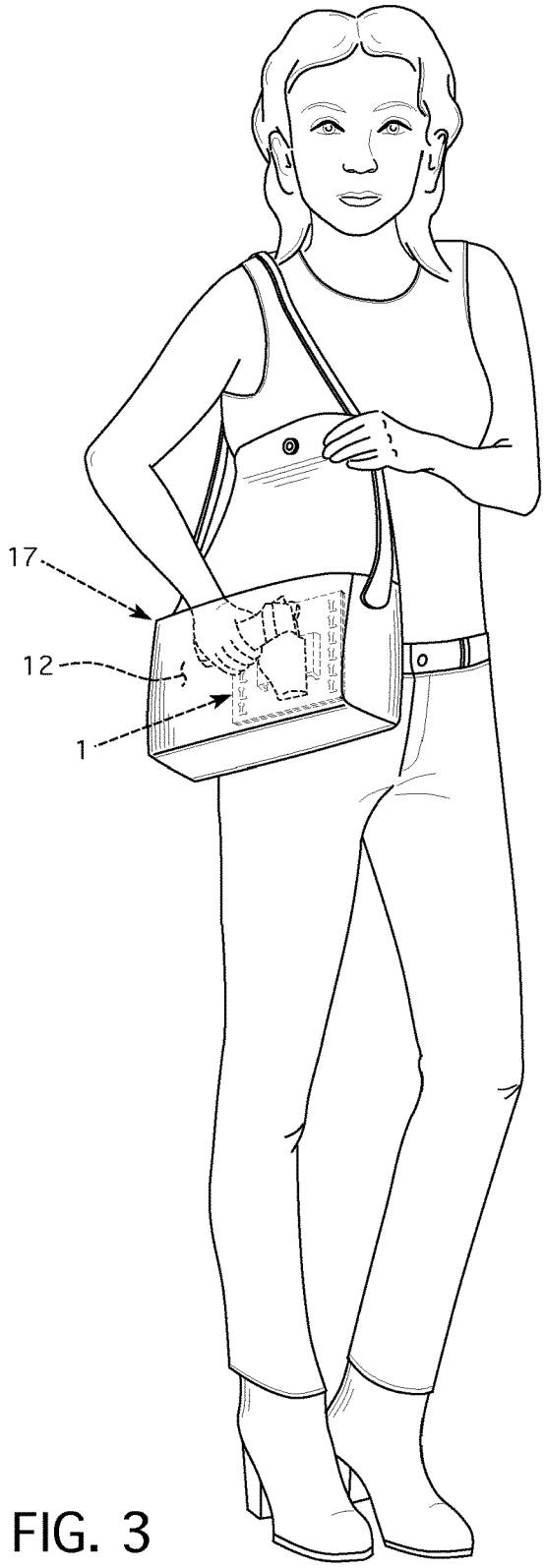
FIG. 3: Shows a person holding a purse and grasping to draw handgun using device.

FIG. 3 shows a person wearing a purse and grasping to draw handgun using the device. A person holding purse 17 can now easily reach in and grasp a handgun from a holster secured to interior 12 of purse 17 by device 1 to draw quickly in a self-defense scenario.

Figure 4A:
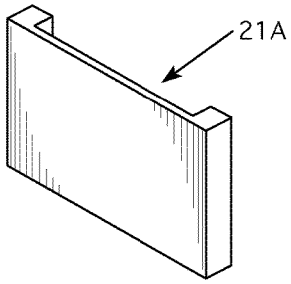
FIG. 4A: Shows a holster support comprised of solid material.
Figure 4B:
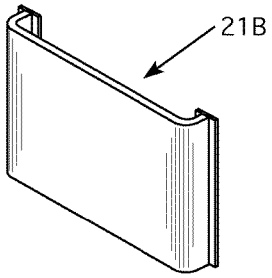
FIG. 4B: Shows a holster support comprised of flexible material.
Figure 4C:
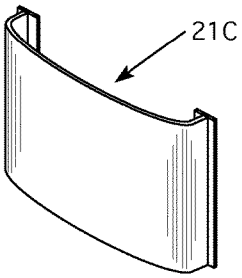
FIG. 4C: Shows a holster support comprised of elastic band material.
Figure 4:
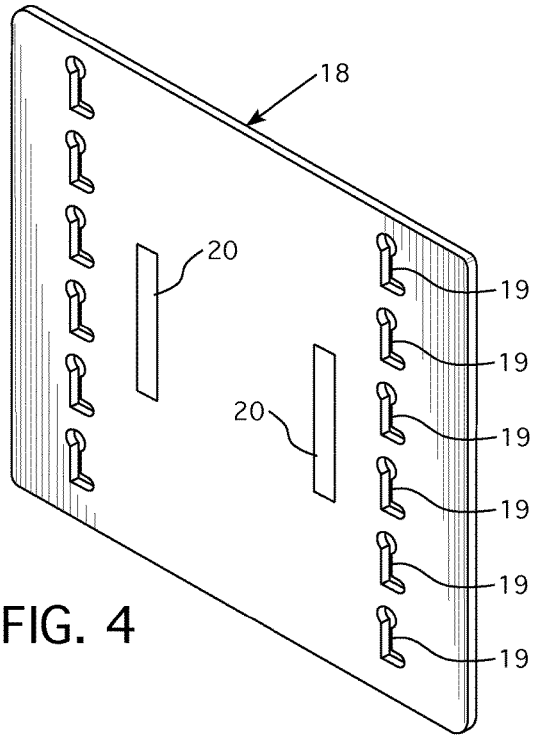
FIG. 4: Front view of panel of an embodiment of the device with various detachable holster supports.

FIG. 4 depicts a front view of a panel of an embodiment of the device with various detachable holster supports. In this embodiment, panel 18 is comprised of a plurality of panel holes 19 and support attachments 20 used for attaching various holsters supports 21*a*, 21*b*, and 21*c*. Bolster supports can be made of varying materials, for example, in FIG. 4A 21*a* is comprised of the same solid material that comprises the panel 18, in FIG. 4B 21*b* is comprised a flexible material such a plastic, and in FIG. 4C 21*c* is an elastic band. These examples of materials comprising detachable holster supports are not meant to be limiting, any feasible material for a holster support known in the art is contemplated for the purse mount device. Holster supports can attach to the panel in any manner known to someone with skill in the art. The size of the holster support can also be varied to accommodate various handgun holster combinations.

Figure 5:
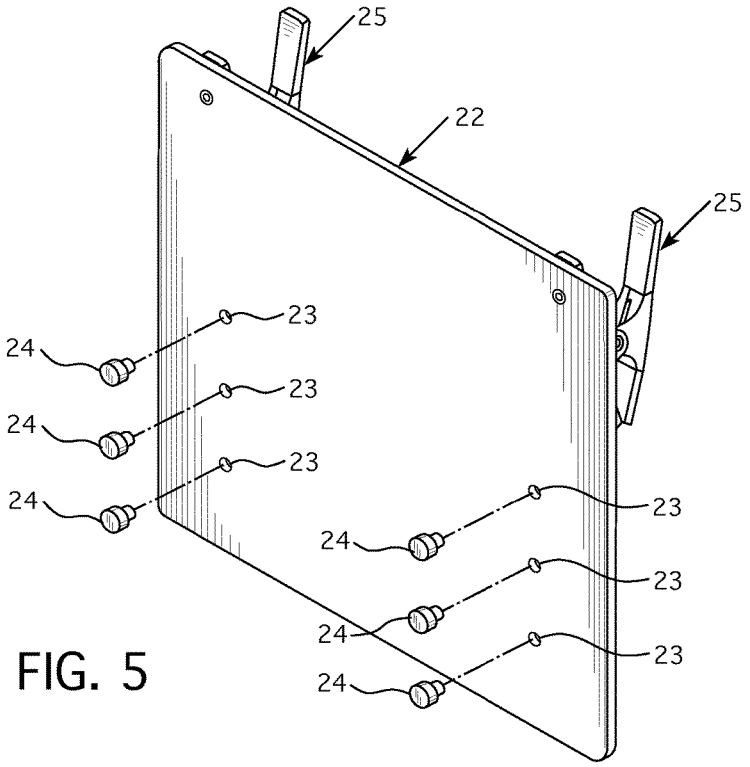
FIG. 5: Front view of base plate of an embodiment of the device with independent pegs.

FIG. 5 depicts a front view of a base plate of an embodiment of the device with independent pegs. Base plate 22 is comprised of a plurality of peg holes 23. Independent pegs 24 can be inserted into peg holes 23 to form an assembled base plate. Attached to the base plate 22 are attached clips 25.

Figure 6:
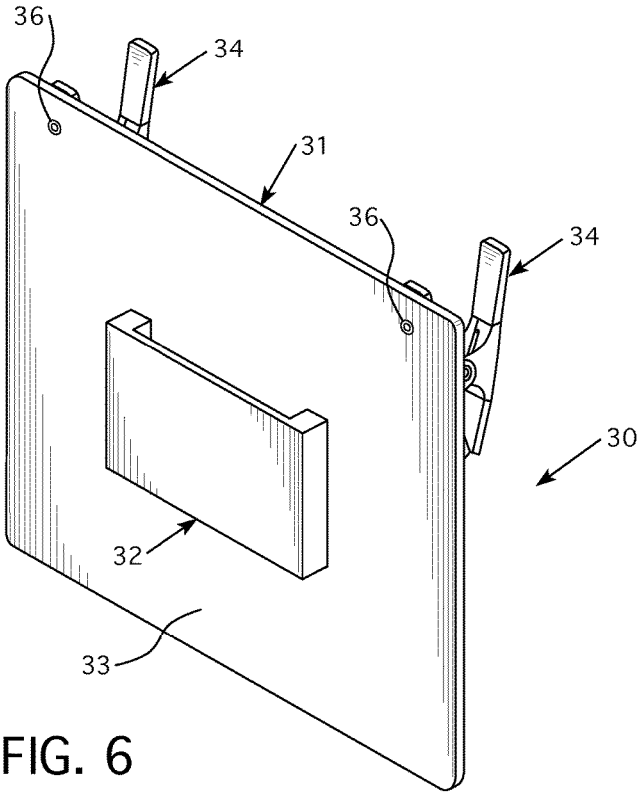
FIG. 6: depicts a non-adjustable-embodiment of the device.

FIG. 6 depicts a non-adjustable-embodiment of the device. Device 30 is comprised of backing 31 with holster support 32 on front side 33 and backing holes 35 in which clips 34 are attached via rivets 36. Holster support 32 can be either permanently attached or can be releasably detachable.

A preferred material comprising the injection molded embodiments is polycarbonate. Other possible include polypropylene, polyethylene, ABS and PC-ABS, polystyrene (HIPS and GSSP), acrylic, nylon 6/6 PBT, acetal PVC, TPE, Noryl, TPU, and polysulphone. These disclosed materials are not meant to be limiting, any feasible materials known to those skilled in the art are contemplated by this disclosure. Characteristics of materials that can be used include, but are not limited to, being relatively strong and durable at a relatively thin width, being lightweight for everyday use, being heat and cold tolerant and being easy to use for injection molding. The injection molded embodiments can be manufactured by any feasible injection, mold technique known to those with ordinary skill in the art.

The foregoing description merely illustrates the invention is not intended to be limiting. It will be apparent to those skilled in the art that various modifications can be made without departing from the inventive concept. Accordingly it is not intended that the invention be limited except by the appended claims.

The invention claimed is:

1. A purse mounted device comprising:

a panel and a base plate;

the panel comprising a holster support on a front side and a plurality of panel holes; each panel hole is comprised of a rounded shape space in an upper position and an L shape space in a lower position;

the base plate comprising a front side, said front side is a flat surface on which a plurality of pegs is attached, and a plurality of attached clips;

wherein the panel and the base plate interlock via the pegs and the panel holes to form an assembled device.

2. The device of claim 1 wherein the panel and the holster support are one manufactured piece.

3. The device of claim 2 wherein the panel and the holster support are made by an injection molding technique.

4. The device of claim 1 wherein the base plate and the plurality of pegs are one manufactured piece.

5. The device of claim 4 wherein the base plate and the plurality of pegs are made by an injection molding technique.

6. The device of claim 1 wherein alternative placement of the plurality of panel holes interlocking with the plurality of the pegs allows for height adjustment of the holster support in the assembled device.

7. The device of claim 1 wherein the holster support is detachable.

8. The device of claim 1 wherein the plurality of pegs are detachable.

9. The device of claim 1 wherein the plurality of attached clips is at least two.

10. The device of claim 1 wherein the plurality of attached clips are spring clamps.

11. The device of claim 1 wherein the panel and base plate are comprised of polycarbonate.

12. The device of claim 7 wherein the holster support is comprised of the same material as the panel.

13. The device of claim 7 wherein the holster support is comprised of a flexible plastic.

14. The device of claim 7 wherein the holster support is an elastic band.

15. The device of claim 1 wherein the panel and base plate are a square shape.

16. The device of claim 15 wherein the square shape has rounded corners.

17. The device of claim 1 wherein the holster support is centrally placed on the front side of the panel.

* * * * *